United States Patent [19]

Noack

[11] 4,012,195

[45] Mar. 15, 1977

[54] CATALYZED HYDRAZINE COMPOUND CORROSION INHIBITING COMPOSITION AND USE

[75] Inventor: Manfred G. Noack, Northford, Conn.

[73] Assignee: Olin Corporation, New Haven, Conn.

[22] Filed: Aug. 21, 1975

[21] Appl. No.: 606,550

[52] U.S. Cl. ..... 21/2.7 R; 106/14; 252/389 R; 252/400 R

[51] Int. Cl.[2] ..... C23F 11/00; C23F 11/12; C23F 11/14

[58] Field of Search ..... 21/2.7 R; 252/389 R, 252/390, 383, 384, 400 R, 401, 405; 106/14

[56] References Cited

UNITED STATES PATENTS

| | | | |
|---|---|---|---|
| 2,270,577 | 1/1942 | Bergstrom et al. | 252/401 |
| 3,556,748 | 1/1971 | Stedman | 252/401 |
| 3,625,888 | 12/1971 | Redmore | 252/389 R |
| 3,639,263 | 2/1972 | Troscinski et al. | 21/2.7 R |
| 3,645,896 | 2/1972 | Larsen | 21/2.7 R |
| 3,686,123 | 8/1972 | Hiroshi | 21/2.7 R |
| 3,687,610 | 8/1972 | Gilson et al. | 21/2.7 R |
| 3,785,995 | 1/1974 | Kalil | 252/384 |

*Primary Examiner*—Norman Yudkoff
*Assistant Examiner*—Dale Lovercheck
*Attorney, Agent, or Firm*—William A. Simons; F. A. Iskander

[57] ABSTRACT

Corrosion inhibiting compositions are described which contain a hydrazine compound and an organometallic complex. The organometallic complex is the reaction product of a cobaltous, manganous, or cupric inorganic salt and one or more ortho aromatic ligands containing at least two hydroxy or two amino functional groups or at least one amino and one hydroxy group. The use of these compositions as oxygen scavengers in corrosive environments is also described.

24 Claims, No Drawings

CATALYZED HYDRAZINE COMPOUND CORROSION INHIBITING COMPOSITION AND USE

The present invention is directed to catalyzed hydrazine compound corrosion inhibiting compositions and their use in corrosive environments. More particularly the present invention is directed to compositions comprising a hydrazine compound and a catalytic organometallic complex which enhances oxygen scavenging. The present invention is further directed to the use of these compositions to inhibit or reduce corrosion.

It is well known to use hydrazine compounds for the removal of oxygen from gases and liquids to retard the corrosion of metal surfaces. Among the more important commercial uses of hydrazine compounds for this purpose are in water and steam apparatus such as boilers, hot water heating systems and water cooling systems. These hydrazine compounds are also used in inorganic and organic fluid heat exchange systems, e.g., alkylene glycol coolant systems. It is believed that the hydrazine compound reacts in the system so that hydrogen from the hydrazine compound combines with the oxygen to form water or other compound so as to bind up the oxygen and thereby inhibit corrosion.

The rate of reaction of a hydrazine compound, e.g., hydrazine, monomethyl hydrazine or the like, with oxygen at ambient temperatures or lower, is relatively slow. As a result, numerous suggestions have been made in the art to add catalytic or accelerating agents to the hydrazine compound to facilitate oxygen removal or scavenging in fluidic corrosive environments. Thus, it has been suggested that various catalysts be employed in conjunction with the hydrazine compound such as is described, for example, in U.S. Pat. Nos. 3,551,349 to Kallfass, 3,728,281 to Marks et al., 3,808,138 to Yamaguchi, et al. and 3,843,547 to Kaufman et al. .

It has now been discovered that certain compounds when used in combination with a hydrazine compound in corrosive environments significantly increase the rate of reaction of the hydrazine compound in removing oxygen and this is so to a surprisingly significant degree even at ambient or lower temperatures. The organometallic complexes used in the compositions which comprise the present invention have not heretofore been taught or suggested in the prior art literature including the above-mentioned patents and yet they are high performers as hydrazine compound oxygen scavenging catalysts.

The novel compositions of the present invention contain a hydrazine compound and a catalytic organometallic complex, as mentioned. The hydrazine compound employed in the compositions of the present invention may be hydrazine itself or it may be any of the hydrazine compounds which function as oxygen scavengers in fluidic corrosive environments. Thus, hydrazine compounds such as methylhydrazine, ethylhydrazine, propylhydrazine, butylhydrazine, 1,1-dimethylhydrazine, 1,1-dibutylhydrazine, and higher alkylated hydrazine compounds, as well as aromatic and aralkyl hydrazine compounds, may be employed. The hydrazine compound may be any of these or a mixture of these and may be used in anhydrous form or in an aqueous solution. The aqueous solution is, of course, the more preferred form when the composition is to be used in water-based corrosive environments. When organic fluid environments are involved the hydrazine compound may be used in an organic solution, e.g., in a lower alkylene glycol solution. In addition to the hydrazine compounds mentioned, the inorganic and/or organic hydrazine compound salts may be employed to replace part or all of the hydrazine compound wherever compatible with the fluidic system. Suitable inorganic hydrazine compounds which may be used include hydrazine phosphate, hydrazine monohydrochloride and dihydrochloride, hydrazine monohydrobromide and dihydrobromide, monohydrosulfate and dihydrosulfate, and the like.

When the hydrazine compound is employed in combination with an inorganic or organic solvent, any workable solvent may be used as long as the solvent is compatible with the fluidic corrosive environment which is to be treated. There is no criticality in the amount of solvent employed because the solvent will be compatible with and may become part of the system which is to be treated. However, as a practical matter, regardless of the solvent chosen, generally at least about 1 mole to about 100 moles, and preferably about 1.5 moles to about 10 moles of the solvent is used per mole of hydrazine compound. The exact amount may be somewhat influenced by the particular hydrazine compound chosen or simply may be dictated by the commercial availability of particular solutions. For example, when an aqueous solution is used the solution may contain about 5 to about 64 percent hydrazine compound by weight, based on the total weight of the water and the hydrazine compound. When an organic solution is used, it may contain about 5 to about 40 percent by weight of hydrazine compound, for example, based on the total weight of the organic solvent and the hydrazine compound.

The organometallic complex used in the compositions of the present invention are reaction products of an inorganic salt and an organic ligand. Specifically, the inorganic salt is one of cobalt, manganese, of copper. The inorganic salt is represented by the formula:

$$MX_{(2/n)}$$

wherein M is cobaltous, manganous, or cupric metal ion, X is an inorganic anion, and *n* is the charge of the anion. Thus, the inorganic salt is one of cobalt, manganese, or copper in combination with two uninegative or one dinegative anion such as, for example, $No_3^-$, $Cl^-$, $Br^-$, or $SO_4^-$. The inorganic salt may be used in the form of an aqueous solution or in the anhydrous form as desired.

In order to form the organometallic complex used in the composition of the present invention, the inorganic salt is reacted with one or more organic ligands selected from the group consisting of unsubstituted and substituted ortho diamino aromatic compounds, unsubstituted and substituted ortho dihydroxy aromatic compounds, and unsubstituted and substituted ortho aminohydroxy aromatic compounds. These organic ligands are ortho aromatic compounds which may have only one aromatic ring or may have two or more rings. The substituents which may be part of the organic ligand include any which do not interfere with the formation of the organometallic complexes and with the oxygen scavenger accelerating function of the compositions of the present invention and will include alkyl, aralkyl, and aryl groups, e.g., having about 1 to about 10 and preferably about 1 to about 4 carbon atoms, as well as inorganic substituents such as the sulfonic acid radical and $—PO_3H_2$. While the two functional groups on the organic ligands are the amino and/or hydroxy radicals in the ortho position relative to one another, the inert substituents may be located in any of the positions not occupied by the aforesaid amino and/or hydroxy groups.

Exemplary of the organic ligands which may be used in forming the organometallic complexes used in the composition of the present invention are:

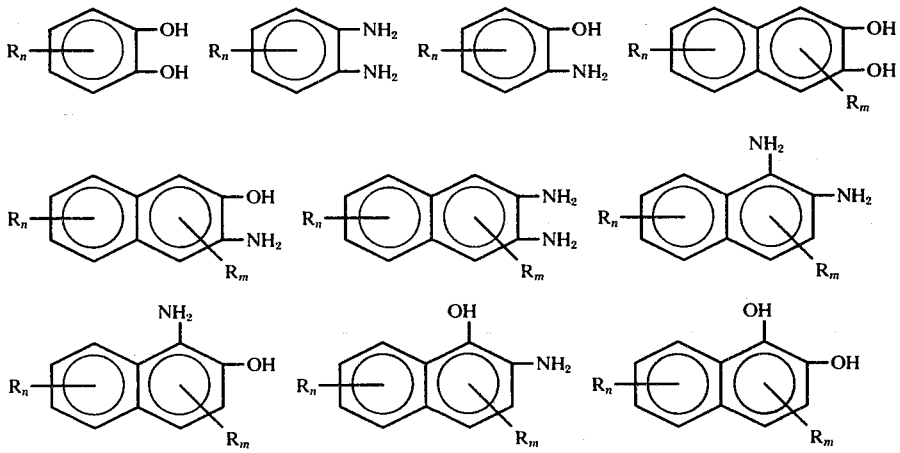

wherein $n$ is an integer from 0 to 4, $m$ is an integer from 0 to 2 and each R is a substituent which does not affect the formation of the organometallic complex and does not detrimentally affect the corrosion inhibiting catalytic functionality of the molecule, e.g., lower alkyl, aralkyl, alkaryl, $—SO_3H$, $—PO_3H_2$ and the like. Also exemplary of the ligands which are useful in the compositon and method of the present invention are the anthracene, phenanthrene and phenalene compounds corresponding to those shown above.

The organic ligand may effectively be employed in an organic solvent solution. The amount of water or other solvent used for the inorganic salt and the amount of organic solvent used for the organic ligand will depend upon the compatibility of the particular inorganic salt, organic ligand, and solvents selected. However, in general about 5 to about 50 moles, and preferably about 20 to about 30 moles, of water or other appropriate solvent may be used per mole of inorganic salt. About 5 to about 40 moles and preferably about 20 to about 30 moles of organic solvent may be used in combination with the organic ligand. Among the preferred solvents for the organic ligand are the lower alkylates, such as ethanol and methanol, as well as acetone, MEK and the like.

In forming the organometallic complexes, the inorganic salt is reacted with the organic ligand so that about 0.1 to about 10 or even more moles, and preferably about 1 to about 4 moles of ligand is used per gram atom of metal ion. These two components may advantageously be combined and reacted at room temperature and at atmospheric pressure. However, lower or higher temperatures and negative or positive pressures may be employed if desired. Thus, temperatures ranging from about 10° to about 100° C and preferably about 20° to about 50° C, and pressures as low as 5 psi up to about 30 psi, and preferably within the range of about 10 to about 15 psi, may be used. At any rate, it can be seen that any combination of temperature and pressure may be used in preparing the organometallic complex provided that there is no significant detrimental effect on the reaction or on the desired products.

The reaction of the inorganic salt and the organic ligand generally occurs in a very short period of time, e.g., instantaneously, and a significant amount of organometallic complex is obtained within a matter of seconds. The organometallic complex may be in liquid form or dissolved in the reaction mixture or it may precipitate out of the reaction mixture. Regardless of the particular form of the organometallic complex, the complex is compatible with the reaction mixture and may be stored therein for an indefinite period of time. Because the reaction occurs in most cases somewhat instantaneously, and because the desired product may be stored in the reaction mixture, there is no criticality to the residence time involved in the reaction between the inorganic salts and the organic ligands used in the present invention. However, if desired, the organometallic compound may be separated from the reaction mixture by any conventional means, e.g., by filtration or by distillation of the solvent. Alternatively, the organometallic compound need not be separated from the reaction mixture and the entire entity may be used as a component for the composition of the present invention.

The organometallic complex obtained may subsequently be combined with the hydrazine compound to form a composition of the present invention. In general, about 0.002 parts to about 0.04 parts of an organometallic complex is combined with one part by weight of the hydrazine compound. Preferably at least about 0.005 parts to about 0.02 part of the organometallic complex is used per part of hydrazine compound to form the composition of the present invention prior to use of the composition as a corrosion inhibitor or the two components may be combined by adding each of them to the fluid in the system to be treated. When an aqueous solution of the hydrazine compound is used, and this is particularly preferable for treating water containing systems, about 5 to about 64 percent by weight of the hydrazine compound and preferably about 10 to about 35 percent of the hydrazine compound may be used in combination with about 0.1 to about 5 percent and preferably about 0.5 to about 1 percent of the organometallic complex, the remainder being water.

As alternatives to combining the organometallic complex with the hydrazine compound either before or after being added to the fluidic corrosive environment to be treated, other approaches may advantageously be used. In one preferred embodiment, the organic ligand may be dissolved in a hydrazine compound solution and the inorganic salt either in solid or solution form may subsequently be combined with the organic ligand-hydrazine compound solution, either before or after the organic ligand-hydrazine compound solution is added to the fluid system to be treated. In another preferred embodiment of the present invention, the inorganic salt may first be dissolved in a hydrazine compound solution and then the organic ligand may be combined therewith either before or after the inorganic salt-hydrazine compound solution is added to the fluidic system to be treated. In yet another preferred embodiment, the hydrazine compound, the organic ligand and the inorganic salt may each independently be added to the fluidic corrosive environment to be treated. It should be noted that in those embodiments wherein the inorganic salt and the organic ligand are not combined until added to the fluidic system to be treated, the organometallic complex is formed in situ. It should also be noted that regardless of the particular combining approach taken the relative amount of hydrazine compound, organic ligand and inorganic salt used are those set forth above.

In the method of the present invention the compositions are used to inhibit oxygen corrosion in fluidic corrosive environment as mentioned. The compositions are generally combined with the system to be treated so that at least about a stoichiometric amount of hydrazine compound is present based on the amount of dissolved oxygen in the system. Typically, this may means that the composition is used so that the hydrazine compound concentration in the fluidic system, after admixing, but before reaction with the dissolved oxygen takes place, is in the range of about 0.001 to about 1,000 ppm, e.g., about 0.01 to about 500 ppm. The particular method used in combining the corrosion inhibiting compositions of the present invention may be any of those which have been previously described and the physical techniques of addition may be any of those which are well known in the art with respect to the use of hydrazine as an oxygen scavenger. Likewise, the methods of determining the amount of oxygen present in a fluidic system are well known in the art and need not be described herein.

The following examples of the present invention are presented for illustrative purposes only, and the present invention should not be construed to be limited thereto:

EXAMPLE 1

About 10 grams (0.82 moles) of 3,4-toluene diamine (3,4TDA) and about 350 milliliters (6 moles) of ethanol are added to a reaction flask. About 10 grams (0.042 moles) of $CoCl_2 . 6H_2O$ is added to the flask and a deep blue precipitate is immediately formed without the addition of heat and at atmospheric pressure. The deep blue precipitate is isolated by filtration from the reaction mixture. The precipitate is subsequently analyzed and found to be the organometallic complex having the formula $[Co(3,4\text{-}TDA)_2]Cl_2$ and it is determined that a 72 percent yield is obtained.

EXAMPLE 2

About 3.3 grams of the organometallic complex $[Co(3,4\text{-}TDA)_2]Cl_2$ obtained in Example 1 is combined with 267 ml of hydrazine hydrate (176 grams $N_2H_4$) and 150 ml of $H_2O$ to give an orange-colored stock solution. The aqueous composition is found to contain 41 percent $N_2H_4$ and organometallic complex catalyst at about 0.01 parts of catalyst percent of $N_2H_4$ by weight (0.77 percent). Traces of solids remain undissolved and are allowed to settle out and are separated from the solution to obtain a commercially viable corrosion inhibiting composition.

EXAMPLE 3

Two identical test samples of air-saturated solution are prepared in two separate Erhlemeyer flasks of 1060 ml capacity by dissolving sodium carbonate and sodium hydrogen carbonate in distilled water until pH 10.0 is indicated by a pH meter equipped with glass electrode. Heating and cooling is then applied to the stirred solutions until both are at a temperature of 25.0° C. Dissolved oxygen is determined in both samples by means of a commercially available oxygen meter equipped with selective membrane electrode. Hydrazine solution prepared in accordance with Example 2 is then injected into one of these flasks in sufficient quantity to bring the hydrazine concentration before reaction with oxygen to 175 ppm and the subsequent decrease in oxygen concentration is measured as function of time. This experiment is repeated with the second flask except that hydrazine without the $[Co(3,4\text{-}TDA)_2]Cl_2$ complex catalyst is used. Oxygen concentrations shown as function of time after hydrazine injection shown in Table I demonstrate the catalytic activity of the $[Co(3,4\text{-}TDA)_2]Cl_2$ complex in promoting the reaction between hydrazine and oxygen. The hydrazine activated with the catalytic organometallic complex removes 96 percent of the initially present oxygen within 10 minutes whereas hydrazine without the catalyst only removes 31 percent in the same period of time.

Table 1

Chemical Oxygen Removal With Hydrazine In Presence and Absence of Organometallic Complex Catalyst

| (Dissolved $O_2$ in ppm vs. Time in Minutes) | | | | | |
|---|---|---|---|---|---|
| Time: | 0 | 3 | 5 | 7 | 10 |
| Hydrazine with $Co(3,4\text{-}TDA)_2Cl_2$: | 7.4 | 4.6 | 2.4 | 0.7 | 0.3 |
| Hydrazine without catalyst: | 8.7 | 7.4 | 6.8 | 6.4 | 6.0 |

EXAMPLE 4

An oxygen-removing composition corresponding in principle to the activated hydrazine solution in accordance with Example 2 is prepared by a simplified procedure wherein prior isolation of the catalytic complex as described in Example 1 is unnecessary. Hydrazine activated with organometallic $Co(3,4\text{-}TDA)_2Cl_2$ catalyst is thus prepared by first dissolving 222 mg (1.81 millimoles) of 3,4-TDA in a mixture of 50 ml (about 1 mole) of hydrazine hydrate and 25 ml of distilled water. Subsequently, about 0.22 grams (0.92 millimoles) of $CoCl_2 — 6H_2O$ in 1.1 ml distilled water is added to adjust the molar ratio of 3,4-TDA/Co++ approximately to the value of 2. This value reflects the proportions of cobaltous ion and 3,4-TDA ligand in the catalytic complex. The orange-colored solution which is obtained is found to react rapidly with dissolved oxygen as shown in Table II below.

EXAMPLE 5

The procedure described in Example 4 is repeated except that about 0.14 grams (0.92 millimoles) of $MnSO_4$ dissolved in 1.1 ml distilled water is employed in place of the cobalt solution. A colorless solution of hydrazine is obtained which exhibits a rapid rate of reaction with dissolved oxygen as shown in Table II.

EXAMPLE 6

The procedure described in Examples 4 and 5 is repeated except that about 0.15 grams (0.92 millimoles) of $CuSO_4$ dissolved 1.1 ml distilled water is added to the solution of 3,4-TDA in aqueous hydrazine. A portion of the $CuSO_4$ so added precipitates immediately as $Cu_2O$ whereas another portion corresponding to 600 ppm Cu remains in solution unexpectedly. Oxygen removal with the clear, supernatant portion of hydrazine solution is found to be extremely fast as illustrated in Table II.

EXAMPLES 7 and 8

The procedure of Examples 4 and 5 is repeated except that 200 mg (1.82 millimoles) of 1,2-dihydroxybenzene (pyrocatechol) is employed instead of the 3,4-TDA. Quantities of 0.92 millimoles of $CoCl_2$ (Example 7) and of $MnSO_4$ (Example 8) are then admixed as aqueous solutions to obtain the activated hydrazine compositions corresponding to Examples 7 and 8 respectively. The acceleration of oxygen removal which results from the use of these compositions is shown in Table II.

EXAMPLES 9 to 11

Hydrazine solutions contaning $CoCl_2$, $MnSO_4$, and $CuSO_4$ as metal salt component of the organometallic catalyst are prepared in accordance with the procedures described in Examples 4, 5, and 6 respectively, except that 436 mg (1.82 millimoles) of 1-amino-2-naphtol-4-sulfonic acid are employed instead of the 3,4-TDA. The high reactivity of the resulting activated hydrazine solutions is shown in Table II.

EXAMPLES 12 to 15

Oxygen scavenger solutions consisting of hydrazine, $CoCl_2$, 3,4-TDA and distilled water are prepared by the procedure described in Example 4 except that the hydrazine and 3,4-TDA concentrations are chosen to be 35 percent and 0.5 percent, respectively, whereas varying amounts of $CoCl_2$ are admixed corresponding to the molar ratios 3,4-TDA/Co++ which are shown below:

Example 12: 3,4-TDA/Co++ = 2.0
Example 13: 3,4-TDA/Co++ = 3.0
Example 14: 3,4-TDA/Co++ = 4.0
Example 15: 3,4-TDA/Co++ = 5.0

High reactivity with dissolved oxygen corresponding to hydrazine activated by catalysts is exhibited by all of these solutions as shown in Table II.

EXAMPLES 16 to 18

Oxygen scavenger solutions containing 35 percent $N_2H_4$ and approximately 0.67 percent organometallic catalyst consisting of $CoCl_2$, 3,4-TDA and pyrocatechol in the molar proportions shown below are prepared by suitably adapting the procedures of Examples 4, 5 and 6.

Molar Proportions: $CoCl_2$/3,4-TDA/Pyrocatechol

Example 16: 1.0/1.1/1.1
Example 17: 1.0/1.7/0.5
Example 18: 1.0/2.0/0.2

The high reactivity of these hydrazine solutions with dissolved oxygen is shown in Table II.

EXAMPLE 19

Rates of reactions of hydrazine with molecular oxygen dissolved in water at pH 10.0 are measured for the solutions obtained in accordance with Examples 4 through 18 by employing the procedure of Example 3. The results are summarized in Table II which follows:

Table II

| Solution of Example No. | Metal Salt | Organic Component | Oxygen Removal with Activated Hydrazine Solution — Time of Reaction (Min.) 0 | 3 | 5 | 7 | 10 |
|---|---|---|---|---|---|---|---|
| | | | Dissolved $O_2$ in ppm | | | | |
| 4 | $CoCl_2$ | 3,4-TDA | 8.5 | 5.6 | 3.9 | 2.3 | 0.5 |
| 5 | $MnSO_4$ | 3,4-TDA | 8.5 | 5.5 | 4.0 | 2.9 | 1.7 |
| 6 | $CuSO_4$ | 3,4-TDA | 8.6 | 0.5 | 0.3 | — | 0.1 |
| 7 | $CoCl_2$ | Pyrocatechol | 8.6 | 6.0 | 3.9 | 1.8 | 0.5 |
| 8 | $MnSO_4$ | Pyrocatechol | 8.6 | 5.4 | 3.7 | 2.3 | 0.9 |
| 9 | $CoCl_2$ | APSA* | 8.2 | 2.1 | 0.3 | 0.2 | 0.1 |
| 10 | $MnSO_4$ | APSA | 8.6 | 1.6 | 0.3 | — | 0.1 |
| 11 | $CuSO_4$ | APSA | 8.4 | 0.3 | 0.2 | — | 0.1 |
| 12 | $CoCl_2$ | 3,4-TDA | 7.7 | 6.4 | 5.4 | 4.0 | 1.6 |
| 13 | $CoCl_2$ | 3,4-TDA | 7.8 | 6.7 | 5.8 | 4.5 | 2.0 |
| 14 | $CoCl_2$ | 3,4-TDA | 8.0 | 6.2 | 5.0 | 3.6 | 1.2 |
| 15 | $CoCl_2$ | 3,4-TDA | 7.7 | 6.6 | 5.8 | 4.5 | 2.0 |
| 16 | $CoCl_2$ | 3,4-TDA and Pyrocatechol | 8.2 | 5.2 | 2.8 | 0.4 | 0.03 |
| 17 | $CoCl_2$ | 3,4-TDA and Pyrocatechol | 8.3 | 5.7 | 3.5 | 0.8 | 0.05 |
| 18 | $CoCl_2$ | 3,4-TDA and Pyrocatechol | 8.4 | 5.8 | 3.2 | 0.6 | 0.07 |
| No Catalyst | | — | 8.7 | 7.4 | 6.8 | 6.4 | 6.0 |

*APSA = 1-Amino-2-naphthol-4-sulfonic acid.

What is claimed is:

1. A composition, comprising:

a. a hydrazine compound; and b. about 0.002 parts to about 0.04 parts by weight of an organo metallic complex per part of hydrazine compound, said organometallic complex being the reaction product of: (i) an inorganic salt selected from the group consisting of salts of cobalt, manganese and copper; and (ii) one or more organic ligands selected from the group consisting of unsubstituted and substituted orthodiamino aromatic compounds, unsubstituted and substituted orthodihydroxy aromatic compounds and unsubstituted and substituted orthoaminohydroxy aromatic compounds.

2. The composition of claim 1 wherein said hydrazine compound is in anhydrous form.

3. The composition of claim 1 wherein said hydrazine compound is in an aqueous solution containing about 5 to about 64 percent hydrazine compound by weight, based on the total weight of the water and the hydrazine compound.

4. The composition of claim 1 wherein said hydrazine compound is in an organic solvent solution containing about 5 to about 40 percent hydrazine compound by weight, based on the total weight of the organic solvent and the hydrazine compound.

5. The composition of claim 1 wherein said inorganic salt has the formula: $MX_{(2/n)}$ wherein M is selected from the group consisting of cobaltous, manganous and cupric metal ions, X is an inorganic anion, and *n* is the charge of the anion.

6. The composition of claim 5 wherein about 0.005 parts to about 0.02 parts by weight of the organometallic complex is used per part of hydrazine compound.

7. The composition of claim 6 wherein said organometallic complex is the reaction product of an inorganic salt as recited, and a mixture of unsubstituted orthodiamino aromatic compounds and unsubstituted orthodihydroxy aromatic compounds.

8. A method of treating a fluidic corrosive environment to remove oxygen therefrom and inhibit corrosion therein, which comprises: treating said environment with a composition comprising:

a. a hydrazine compound; and b. about 0.002 parts to about 0.04 parts by weight of an organometallic complex per part of hydrazine compound, said organometallic complex being the reaction product of: (i) an inorganic salt selected from the group consisting of salts of cobalt, manganese, and copper; and (ii) one or more organic ligands selected from the group consisting of unsubstituted and substituted orthodiamino aromatic compounds, unsubstituted and substituted orthodihydroxy aromatic compounds and unsubstituted and substituted ortho aminohydroxy aromatic compounds.

9. The method of claim 8 wherein said hydrazine compound is in anhydrous form.

10. The method of claim 8 wherein said hydrazine compound is in an aqueous solution containing about 5 to about 64 percent hydrazine compound by weight, based on the total weight of the water and the hydrazine compound.

11. The method of claim 8 wherein said hydrazine compound is in an organic solvent solution containing about 5 to about 40 percent hydrazine compound by weight, based on the total weight of the organic solvent and the hydrazine compound.

12. The method of claim 8 wherein said inorganic salt has the formula: $MX_{(2/n)}$ wherein M is selected from the group consisting of cobaltous, manganous and cupric metal ions, X is an inorganic anion, and *n* is the charge of the anion.

13. The method of claim 12 wherein about 0.005 parts to about 0.02 parts by weight of the organometallic complex is used per part of hydrazine compound.

14. The method of claim 13 wherein said organometallic complex is the reaction product of an inorganic salt as recited, and a mixture of unsubstituted orthodiamino aromatic compounds are unsubstituted orthodihydroxy aromatic compounds.

15. A method of treating a fluidic corrosive environment to remove oxygen therefrom and inhibit corrosion therein, which comprises: adding the following components to said environment:

a. a hydrazine compound in at least about a stoichiometric amount, based on the amount of oxygen to be removed;

b. an inorganic salt having the formula: $MX_{(2/n)}$ wherein M is selected from the group consisting of cobaltous, manganous or cupric metal ions, X is an inorganic ion, and *n* is the charge of the ion; and c. one or more organic ligands selected from the group consisting of unsubstituted and substituted ortho diamino aromatic compounds, unsubstituted and substituted ortho dihydroxy aromatic compounds and substituted and unsubstituted ortho aminohydroxy aromatic compounds, wherein about 0.1 to about 10 moles of ligand are used per gram-atom of metal ion and wherein from about 0.002 parts to about 0.04 parts by weight of total organic ligand and inorganic salt are used per part of said hydrazine compound.

16. The method of claim 15 wherein each of said components are added separately to said environment.

17. The method of claim 15 wherein said organic ligand and said hydrazine compound are combined prior to being added to said environment.

18. The method of claim 15 wherein said inorganic salt and said hydrazine compound are combined prior to being added to said environment.

19. The method of claim 15 wherein said inorganic salt and said organic ligand are combined prior to being added to said environment.

20. The method of claim 15 wherein about 0.005 parts to about 0.02 parts by weight of total organic ligand and inorganic salt are used per part of said hydrazine compound.

21. The method of claim 20 wherein each of said components are added separately to said environment.

22. The method of claim 20 wherein said organic ligand and said hydrazine compound are combined prior to being added to said environment.

23. The method of claim 20 wherein said inorganic salt and said hydrazine compound are combined prior to being added to said environment.

24. The method of claim 20 wherein said inorganic salt and said organic ligand are combined prior to being added to said environment.

* * * * *